United States Patent [19]

Wyse

[11] Patent Number: 4,825,976

[45] Date of Patent: May 2, 1989

[54] SCAFFOLDING PLATFORM

[75] Inventor: Steven J. Wyse, Archbold, Ohio

[73] Assignee: Bil-Jax, Inc., Archbold, Ohio

[21] Appl. No.: 238,596

[22] Filed: Aug. 31, 1988

[51] Int. Cl.[4] ..... E04G 5/08

[52] U.S. Cl. ..... 182/222; 182/119

[58] Field of Search ..... 182/222, 223, 119, 179, 182/178

[56] References Cited

U.S. PATENT DOCUMENTS

| | | | |
|---|---|---|---|
| 3,305,046 | 2/1967 | Schar | 182/222 |
| 3,434,567 | 3/1969 | Wilkins | 182/222 |
| 3,565,212 | 2/1971 | Johnson | 182/222 |
| 3,628,628 | 12/1971 | Gilbreath | 182/222 |
| 4,331,218 | 5/1982 | Layher | 182/222 |
| 4,499,967 | 2/1985 | Anderson | 182/222 |
| 4,561,165 | 12/1985 | Bayer | 182/119 |

*Primary Examiner*—Reinaldo P. Machado

*Attorney, Agent, or Firm*—Allen D. Gutchess, Jr.

[57] ABSTRACT

A scaffolding platform is provided which is stronger and more resistant to damage. The platform includes two longitudinally-extending parallel rails and transverse, parallel cross rails affixed at least to end portions of the longitudinal rails. Mounting hooks for mounting the platforms on scaffold frames are affixed to end portions of the longitudinal rails by fasteners which are located on both sides of one of the transverse rails for each hook, there preferably being four fasteners for each hook. One end of each of the transverse rails has a notch to straddle the body of one of the mounting hooks between its two pair of fasteners.

17 Claims, 2 Drawing Sheets

SCAFFOLDING PLATFORM

This invention relates to a scaffolding platform with mounting hooks, which platform is more resistant to damage.

Scaffolding platforms of the type with which the invention is concerned are commonly known as walkboards or catwalks in the art. Such platforms are supported by end mounting hooks on suitable scaffolding frames at elevated positions above the ground. A common use of such platforms, for example, is to support brick layers as they lay up a brick wall. From time to time, the platforms are raised to upper levels and supported on upper framework of the scaffolding.

After a job is complete, it is common for the workmen to dis-assemble the platforms by separating the mounting hooks from the framework and simply dropping them to the ground from whatever height they happen to be. This has frequently resulted in damage to the mounting hooks and particularly to the portions of the platform frame to which they are attached. Since the mounting hooks and their connections to the platforms are critical to the safety of the platforms, it may be necessary to scrap an entire platform with one damaged hook.

The present invention provides a scaffolding platform which is more resistant to damage and is stronger. More specifically, the design and manner in which the mounting hooks are fastened to the platform frame enables the platform to be more resistant to damage.

The mounting hook in accordance with the invention includes a mounting portion and a hook portion. The mounting portion is designed to be affixed to longitudinal rails of the platform at spaced locations which are on each side of a cross rail extending between the longitudinal rails. This has been found to provide considerably greater resistance to sharp forces acting on the hooks when the platforms are dropped or otherwise mishandled. The mounting portion of the hook includes two mounting bodies connected by a thinner web with fasteners received through the mounting bodies into the longitudinal rails of the platform. At each end of the platform, one of the hooks is mounted on the inside of the longitudinal rail. An end of the corresponding cross rail is notched to fit over the thinner web extending between the mounting bodies of the hook so as to straddle that hook.

Each of the mounting bodies is preferably secured to the corresponding longitudinal rail by two fasteners so that each hook is affixed to the longitudinal rail by four fasteners. However, it is important that there be at least one fastener between the mounting hook and the longitudinal rail on each side of the corresponding cross rail.

It is, therefore, a principal object of the invention to provide a scaffolding platform which is stronger and more resistant to damage.

Another object of the invention is to provide a scaffolding platform with mounting hooks which are more securely and rigidly affixed to longitudinal rails of the scaffolding platform.

Many other objects and advantages of the invention will be apparent from the following detailed description of a preferred embodiment thereof, reference being made to the accompanying drawings, in which.

Figure 1:
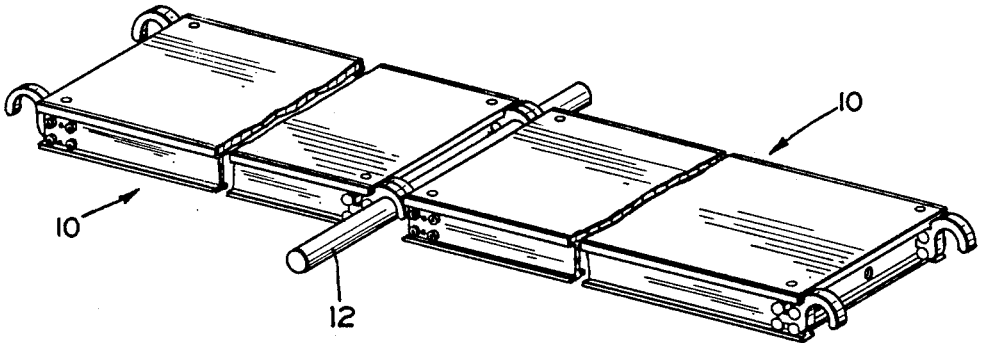
FIG. 1 is a somewhat schematic view in perspective of two scaffolding platforms supported on suitable scaffolding framework.

Referring to the drawings and particularly to FIG. 1, two scaffolding platforms are indicated at 10 and are supported on a scaffolding framework, a member of which is indicated at 12. The scaffolding platforms are typically seven feet long and of various widths. The platforms typically support workmen adjacent a wall and the platforms are raised to upper scaffolding framework members as the need arises.

Figure 2:
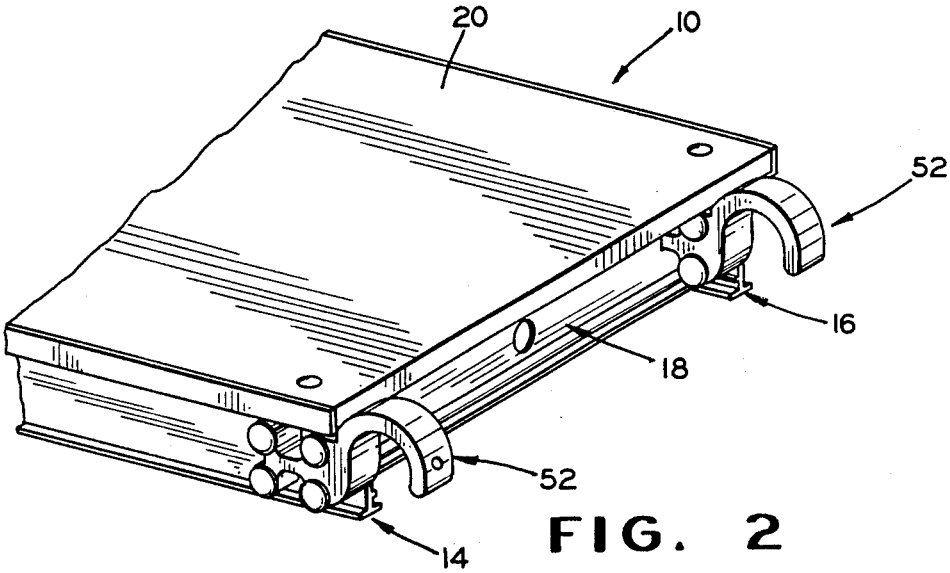
FIG. 2 is an enlarged, fragmentary view in perspective of an end portion of one of the scaffolding platforms of FIG. 1.
Figure 3:
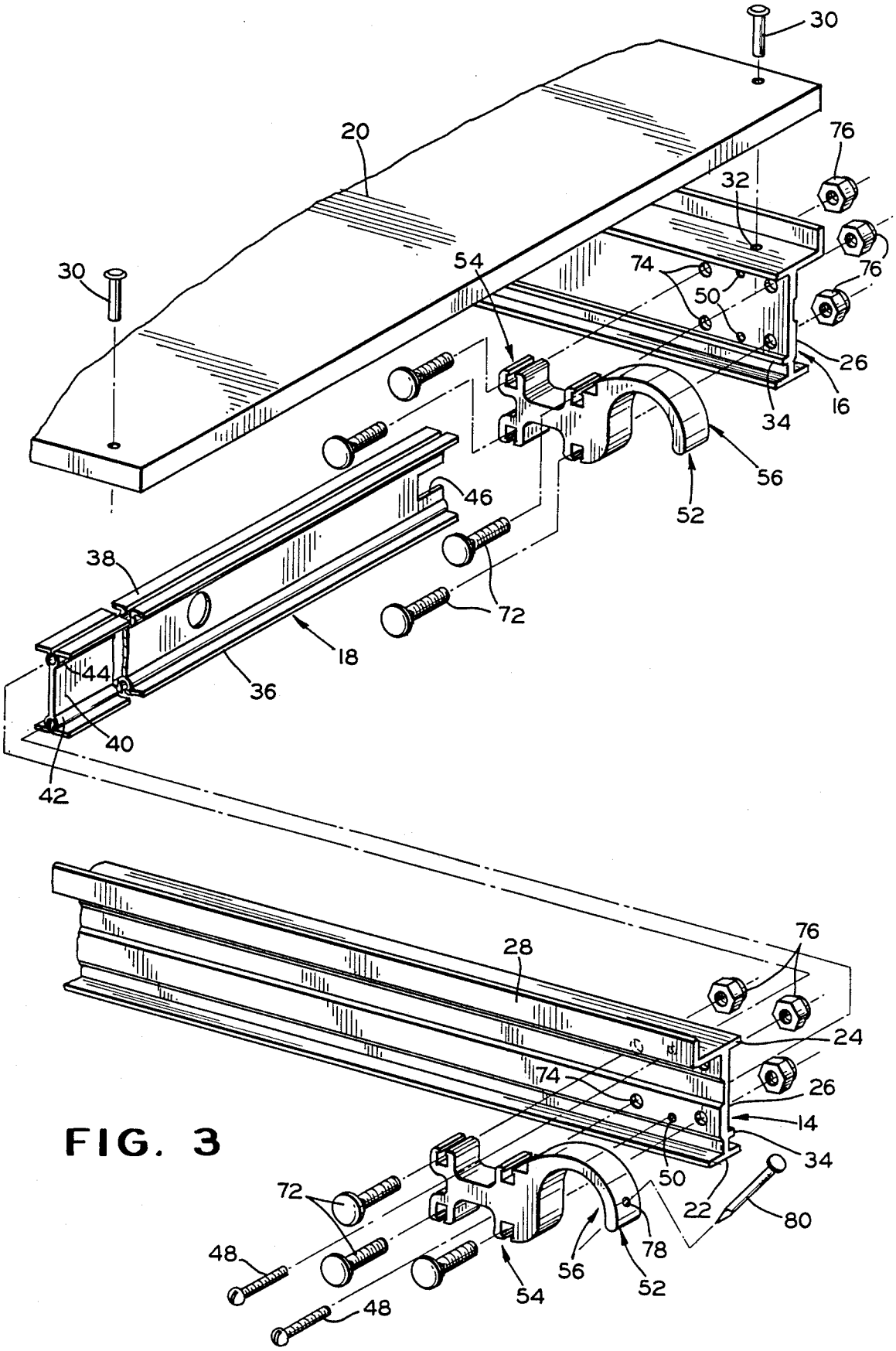
FIG. 3 is a further enlarged, fragmentary, exploded view in perspective of the scaffolding platform end portion shown in FIG. 2.

Referring to FIGS. 2 and 3, the scaffolding platform 10 has two longitudinally-extending rails or members 14 and 16 and transverse rails or members 18, there being one transverse rail near each of the ends of the longitudinal rails and one intermediate cross rail. A top supporting panel or sheet 20, typically of one-half inch plywood or the like, is supported on the longitudinal and transverse rails.

The longitudinal rails 14 and 16 are preferably extruded and are mirror images of one another. Each includes a lower flange 22 and an upper, wider flange 24 connected by a wide vertical web 26. The upper flange 24 has an outer, upwardly extending flange 28 which extends outside the edge of the panel 20 to help position and protect it. The panel 20 is supported on the upper flange 24 and fastened thereby by suitable fasteners or rivets 30 which extend through predrilled holes 32. A lower portion of the vertical web 26 has an inwardly-extending lip or ridge 34 on which an end portion of the transverse rail 18 is supported.

The transverse rail 18 is also preferably extruded and includes lower and upper flanges 36 and 38 connected by a vertical web 40. Longitudinally-extending passages or bores 42 and 44 are formed at lower and upper edges of the web 40, adjacent the flanges 36 and 38. One end of the web 40 of each of the rails 18 has a clearance opening or notch 46, which will be discussed more fully subsequently.

The ends of the transverse rail 18 are affixed to end portions of the longitudinal rails 14 and 16 by self-threading screws 48 or the like which extend into the bores 42 and 44. These extend through predrilled holes 50 in the vertical webs 26 of the rails 14 and 16.

Figure 4:
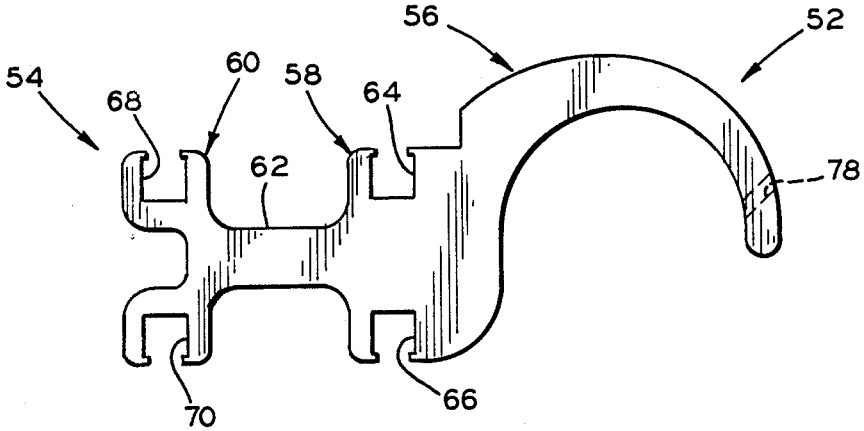
FIG. 4 is a view in elevation of a mounting hook of the scaffolding platform.

Four extruded mounting hooks 52 are affixed to the longitudinal rails 14 and 16 and are supported on the scaffolding framework members 12. Referring particularly to FIG. 4, the extruded mounting hook 52 includes a mounting portion 54 and a hook portion 56 which is of generally inverted U-shaped configuration. The mounting portion 54 includes a front mounting body 58 and a rear mounting body 60 connected by a thinner web 62. The front mounting body 58 has two transverse openings or grooves 64 and 66 at opposite edges thereof which are of generally square U-shaped configuration in transverse cross section and which extend completely between planar sides of the mounting hook. The rear mounting body 60 has similar transverse openings or grooves 68 and 70. With the grooves 64–70 being at the edges of the mounting bodies 58 and 60 extrusion of the hooks 52 is facilitated and the fasteners are positioned further apart in each body for greater strength of the hook connections with the rails.

Referring to FIG. 3, threaded fasteners or bolts 72 extend through the grooves and through predrilled holes 74 of the vertical web 26 of each of the longitudinal rails 14 and 16. The threaded fasteners 72 are preferably carriage bolts with square shanks adjacent the heads. The shanks cooperate with the square grooves to prevent the bolts from turning when threaded nuts 76 are turned thereon.

The bolts 72 for the mounting body 58 extend through the rail web 26 on one side of the transverse rail 18 while the bolts 72 for the mounting body 60 extend through the web 26 on the opposite side of the transverse rail 18. With this arrangement, the scaffolding platform is much more resistant to damage, particularly when the mounting hooks 52 receive blows from being dropped or otherwise mishandled. It is important that at least one of the bolts 72 be positioned on each side of the transverse rail 18 for this purpose.

The mounting hooks 52 are positioned on opposite sides of the ends of each of the longitudinal rails 14 and 16 so that the hooks are offset, as shown in FIG. 1, whereby the hook portions 56 are located in side-by-side relationship when placed on the scaffolding framework member 12. As shown in the upper portion of FIG. 3, the mounting hook 52 located on the inside surface of the vertical web 26 of the rail 18 is straddled by the transverse rail 18 with the end notch 46 thereof received over the thin web 62 of the inside mounting hook 52. This enables the bolts 72 to again be on each side of the transverse rail 18.

As shown in FIGS. 3 and 4, one or both of the mounting hooks 52 at each end of the platform can have transverse holes or bores 78 formed therein to receive nails 80. The nails extend under portions of the framework member 12 and prevent the hooks 52 from being dislodged from the scaffolding framework by wind or other forces.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. A scaffolding platform comprising two parallel rails, parallel cross members affixed to end portions of rails, a planar supporting panel supported on said rails, mounting hooks affixed to end portions of said rails by fasteners, there being at least two of said fasteners on opposite sides of the corresponding cross member, one end of each of said cross members having a clearance opening to straddle a portion of one of said hooks between its fasteners.

2. A scaffolding platform according to claim 1 characterized by said clearance opening being a notch in the one end of each of said cross members.

3. A scaffolding platform according to claim 1 characterized by each of said mounting hooks having a hook portion and a mounting portion, said mounting portion having transverse openings therein to receive said fasteners.

4. A scaffolding platform according to claim 3 characterized by said mounting portion having two mounting bodies, each of said bodies having two of said transverse openings to receive said fasteners.

5. A scaffolding platform according to claim 4 characterized by said mounting bodies being spaced apart by a thinner web.

6. A scaffolding platform according to claim 5 characterized by said web of one of said mounting hooks being received in said clearance opening.

7. A scaffolding platform according to claim 3 characterized by said transverse openings being grooves of generally square U-shaped configuration in transverse cross section and each of said fasteners being a carriage bolt.

8. A scaffolding platform according to claim 4 characterized by said transverse openings being grooves at upper and lower edges of said mounting bodies and in generally vertical alignment in each of said bodies.

9. A scaffolding platform comprising two elongate, longitudinally-extending, parallel rails, parallel cross members affixed to end portions of said rails, four mounting hooks, each affixed to an end portion of one of said rails by at least two fasteners which are spaced apart along the rail on opposite sides of an end of the corresponding cross member, one of said hooks being mounted adjacent an inside surface of an end portion of one of said rails, one of said hooks being mounted adjacent an outside surface of a corresponding end portion of the other rail, one of said hooks being mounted adjacent an outside surface of another end portion of the one rail, one of said hooks being mounted adjacent an inside surface of another end portion of the other rail, each of said cross members having an end notch to straddle a portion of one of said mounting hooks between its fasteners.

10. A scaffolding platform according to claim 9 characterized by each of said mounting hooks having a hook portion and a mounting portion, said mounting portion having transverse openings therein to receive said fasteners.

11. A scaffolding platform according to claim 10 characterized by said mounting portion having two mounting bodies, each of said bodies, each of said bodies having two of said transverse openings to receive said fasteners.

12. A scaffolding platform according to claim 11 characterized by said mounting bodies being spaced apart by a thinner web.

13. A scaffolding platform according to claim 12 characterized by said web of one of said mounting hooks being received in said notch.

14. A scaffolding platform according to claim 10 characterized by said transverse openings being grooves of generally square U-shaped configuration in transverse cross section and each of said fasteners being a carriage bolt.

15. A scaffolding platform according to claim 11 characterized by said transverse openings being grooves at upper and lower edges of said mounting bodies and in generally vertical alignment in each of said bodies.

16. An extruded mounting hook for connecting a scaffolding platform to a scaffold frame, said hook having two planar sides spaced apart a predetermined distance, said hook being of uniform cross-sectional shape throughout its thickness from one of said planar sides to the other, said hook having a mounting portion and a hook portion, said mounting portion having front and rear mounting bodies held in spaced apart relationship by a thinner web, each of said mounting bodies having two grooves at opposite edges thereof which extend completely between the planar sides, the spacing between the two grooves of each of said bodies being greater than the width of the web.

17. A mounting hook according to claim 16 characterized by said grooves being of generally square U-shaped configuration in transverse cross section throughout their lengths.

* * * * *